US006752459B2

(12) United States Patent
Deisig

(10) Patent No.: US 6,752,459 B2
(45) Date of Patent: Jun. 22, 2004

(54) ADJUSTABLE CHAIR

(75) Inventor: Wolfgang Deisig, Berlin (DE)

(73) Assignee: TK Canada Limited, Downsview (CA)

( * ) Notice: Subject to any disclaimer, the term of this patent is extended or adjusted under 35 U.S.C. 154(b) by 0 days.

(21) Appl. No.: 10/204,153

(22) PCT Filed: Feb. 16, 2001

(86) PCT No.: PCT/CA01/00189

§ 371 (c)(1),
(2), (4) Date: Nov. 18, 2002

(87) PCT Pub. No.: WO01/60211

PCT Pub. Date: Aug. 23, 2001

(65) Prior Publication Data

US 2003/0151288 A1 Aug. 14, 2003

(30) Foreign Application Priority Data

Feb. 16, 2000 (DE) ..... 100 07 103

(51) Int. Cl.[7] ..... A47C 1/02

(52) U.S. Cl. ..... 297/316; 297/344.19; 297/344.15; 297/344.16; 297/284.11

(58) Field of Search ..... 297/284.11, 284.3, 297/344.18, 344.19, 339, 340, 316, 344.15, 344.16

(56) References Cited

U.S. PATENT DOCUMENTS

| | | | | |
|---|---|---|---|---|
| 1,619,686 A | * | 3/1927 | Witkowski | |
| 4,693,513 A | * | 9/1987 | Heath | |
| 4,854,641 A | * | 8/1989 | Reineman et al. | 297/344.15 |
| 5,401,077 A | * | 3/1995 | Hosoe | |
| 5,435,623 A | | 7/1995 | Kapec . | |
| 5,536,067 A | | 7/1996 | Pinto | |
| 5,984,411 A | * | 11/1999 | Galumbeck | 297/344.15 |

FOREIGN PATENT DOCUMENTS

| | | | |
|---|---|---|---|
| DE | 43 03 021 A | | 8/1994 |
| EP | 0293136 | | 11/1988 |
| EP | 0371729 | | 6/1990 |
| WO | WO 89/06101 | * | 7/1989 |
| WO | 97 46144 A | | 12/1997 |

* cited by examiner

*Primary Examiner*—Milton Nelson, Jr.
(74) *Attorney, Agent, or Firm*—Michael Best & Friedrich LLP

(57) ABSTRACT

An adjustable work chair such as an office chair has a height-adjustable seat comprising a front seat part (2) and a rear seat part (3) connected by a hinge (4) that extends transversely of the seat. A first arm (15) is coupled between the front part of the seat and the head of a fixed part (13) of a seat lift (14), and a second arm (16) is coupled between an extendable piston of the lift (14) and the underside of the rear part (13) of the seat.

9 Claims, 15 Drawing Sheets

9
12
8
38
13

9
12
8²
8
38
13

9
12
38
13

9
8
12
38
13

ADJUSTABLE CHAIR

FIELD OF THE INVENTION

This invention relates to a chair, for example an office chair, having a height-adjustable seat.

BACKGROUND OF THE INVENTION

DE 43 03 021 A1 discloses an adjustable work chair of this type in which the seat comprises a front part and a back part connected by a transverse hinge and including a first arm connected to the front part of the seat near its front edge and a second arm connected to the back part of the seat. The seat is height-adjustable by means of a lift and can be progressively tilted forwardly from a normal position to an angle of about 15°. The tilt is such that the entire thigh part of a user's leg rests on the seat when the lower part of the leg is extends vertically. A standing work position cannot be achieved with this chair.

Ergonomists and occupational health workers have repeatedly commented on the benefits to health of frequent changes from a seated position to a standing position. New work desks offer an adjustment range from seated to standing work positions. Therefore, there is a need for work chairs with an adjustment range between seated and standing work positions. This does not merely involve enlargement of the adjustment range, which would lead to sitting at standing height, as with bar chairs or chairs with a foot ring for stand-up counters. Rather, the standing work position should allow for leaning or short-term crouching to relieve the feet.

EP 0 293 136 B1 and 0 371 729 B1 disclose chairs with seats that are saddle-shaped and that swivel to allow leaning or short-term crouching in the standing position of the seat. A disadvantage here is that a sit/stand position or a seated position on a tilted seat are not possible because of the saddle shape of the seat.

SUMMARY OF THE INVENTION

An object of the present invention is to provide an improved adjustable work chair providing sit/stand positions.

In accordance with one aspect of the invention, there is provided a chair having a height-adjustable seat comprising a front seat part and a rear seat part connected by a hinge that extends transversely of the seat. The chair has a lift for raising and lowering the seat and the lift includes a fixed part and a movable part that can be extended upwardly with respect to the fixed part. A first arm is connected between the front part of the seat and the fixed part of the lift, and a second arm is connected between the movable part of the lift and the rear part of the seat.

A work chair of this form is adjustable in the sense of the invention in that it is possible to lift the seat from the normal seated position in such a manner that the front part of the seat is turned through an angle of at least 60° from the horizontal. Simultaneously, the back moves up parallel to its original position and a sit/stand or a stand/lean position may be assumed.

A user of the chair may relieve his or her feet by crouching into the rear part of the seat, to which a back rest may be fitted.

Preferably, the seat is divided so that the hinge lies towards the rear of the seat, with the front part forming between a half and two thirds of the overall depth of the seat. A mechanical arrangement allows the front part of the seat to tip downwardly in the upper position. As a result, a shorter seat is presented in the standing or leaning position, as with a high stool. In the sit position, the seat returns to its normal, office chair position and an additional resting position can be attained by tipping the rear part of the seat backwards.

In a first embodiment of the invention, the first arm of the chair is movable both at the front part of the seat and where it joins the movable part of the lift (e.g. the head of an extendable piston). In the second embodiment, the first arm is joined to the front part of the seat so that it is movable but is firmly attached to the fixed part of the lift (e.g. a cylinder receiving the piston). In these two embodiments, the lift may be a gas spring having two individually adjustable lift heights of 190 mm.

The first lift height regulates the seat height between about 400 mm and 590 mm. The second setting regulates the lift from the sit position to the sit/lean position through about 780 mm. Both lifts can be regulated individually so that the second setting is fully expanded in the stand position and the height can be adjusted individually for a small person by means of the first setting. Furthermore, the forward angle of the seat can be regulated individually with the second setting.

In a third embodiment of the invention, the second arm is connected to the back part of the seat at a joint that includes toothed segments. The two arms are coupled together about a common axis defined by an axial spring element such as torsion bar and/or a spring bar at the head of the centre column of the seat support, for the purpose of adjusting the arms with respect to each other. In this embodiment, no lift is necessary. Rather, adjustment of the seat from the seat to the stand position is carried out by simply moving the second arm (attached to the rear part of the seat) upwards, during which the vertical position of the rear part of the seat is maintained by the toothed segments of the joint. At the same time, the front part of the seat can be turned into an almost vertical position about the hinge between the two parts of the seat.

In a further, fourth embodiment, the torsion or spiral spring connects to the top of the centre column by a rack and pinion arrangement which accommodates shifting of weight relative to the centre column of the work chair.

The third and fourth embodiments comprise mechanisms that include a torsion bar and/or spring bar and a static front (first) arm. The third embodiment has a movable rear (second) arm and a centre of gravity that can be adjusted in relation to the torsion bar. The adjustment range of the lift in the seated position is about 260 mm and the lift range in the sit/stand position is about 120 mm. In the fourth embodiment, the torsion bar and/or spiral spring bar is shifted towards the front and up in comparison to the third embodiment, and drives a movable arm that lifts the back part of the seat into the stand/lean position or height. Another spring element (gas-spring or spiral spring) controls synchronized movement of the seat back position in connection with the front torsion bar and/or spiral spring bar and optionally guides the lift mechanism to the stand/lean position. The required adjustment range of the lift in the seated position is about 140 mm to about 160 mm. Lift to the stand/sit position is about 200 mm to 220 mm.

BRIEF DESCRIPTION OF THE DRAWINGS

In order that the invention may be more clearly understood, reference will now be made to the accompanying drawings which illustrate a number of embodiments of the invention by way of example.

In the drawings:

FIG. 1 is a side elevational view of a work chair in accordance with a first embodiment of the invention, shown in the seated position;

FIG. 2 is a side elevational view of the work chair of FIG. 1 in the standing position;

FIG. 3 is a side elevational view of the work chair of FIG. 1 in the rest position;

FIG. 4 is a top plan view of the work chair in the seated position of FIG. 1;

FIG. 5 is a top plan view of the work chair in the standing position of FIG. 2;

FIG. 6 is a side elevational view of a work chair in accordance with a second embodiment of the invention, shown in the seated position;

FIG. 7 is a side elevational view of the work chair according to FIG. 6 in the standing position;

FIG. 8 is a side elevational view of the work chair according to FIG. 6 in the rest position;

FIG. 9 is a top plan view of the work chair according to FIG. 6 in the seated position;

FIG. 10 is a top plan view of the work chair according to FIG. 7 in the standing position;

FIGS. 11 to 14 are principal sectional representations of a gas spring in various elevated positions of the extended piston of the spring;

FIG. 15 is a side elevational view of a work chair in accordance with a third embodiment of the invention, in the seated position;

FIG. 16 is a side elevational view of the work chair according to FIG. 15 in a standing position;

FIG. 17 is a side elevational view of the work chair according to FIG. 15 in the rest position;

FIG. 18 is a top plan view of the work chair according to FIG. 15 in the seated position;

FIG. 19 is a top plan view of the work chair according to FIG. 15 in the standing position;

FIGS. 20 to 22 are representations of rack and pinion arrangements on the centre column according to the third embodiment of FIGS. 15 to 19;

FIG. 23 is a side elevational view of a work chair in accordance with a fourth embodiment of the invention, shown in the seated position;

FIG. 24 is a side elevational view of the work chair according to FIG. 23 in the standing position;

FIG. 25 is a side elevational view of the work chair according to FIG. 23 in the rest position;

FIG. 26 is a top plan view of the work chair according to FIG. 23 in the seated position;

FIG. 27 is a top plan view of the work chair according to FIG. 23 in the standing position.

DESCRIPTION OF PREFERRED EMBODIMENT

Figures 1, 2, 3:
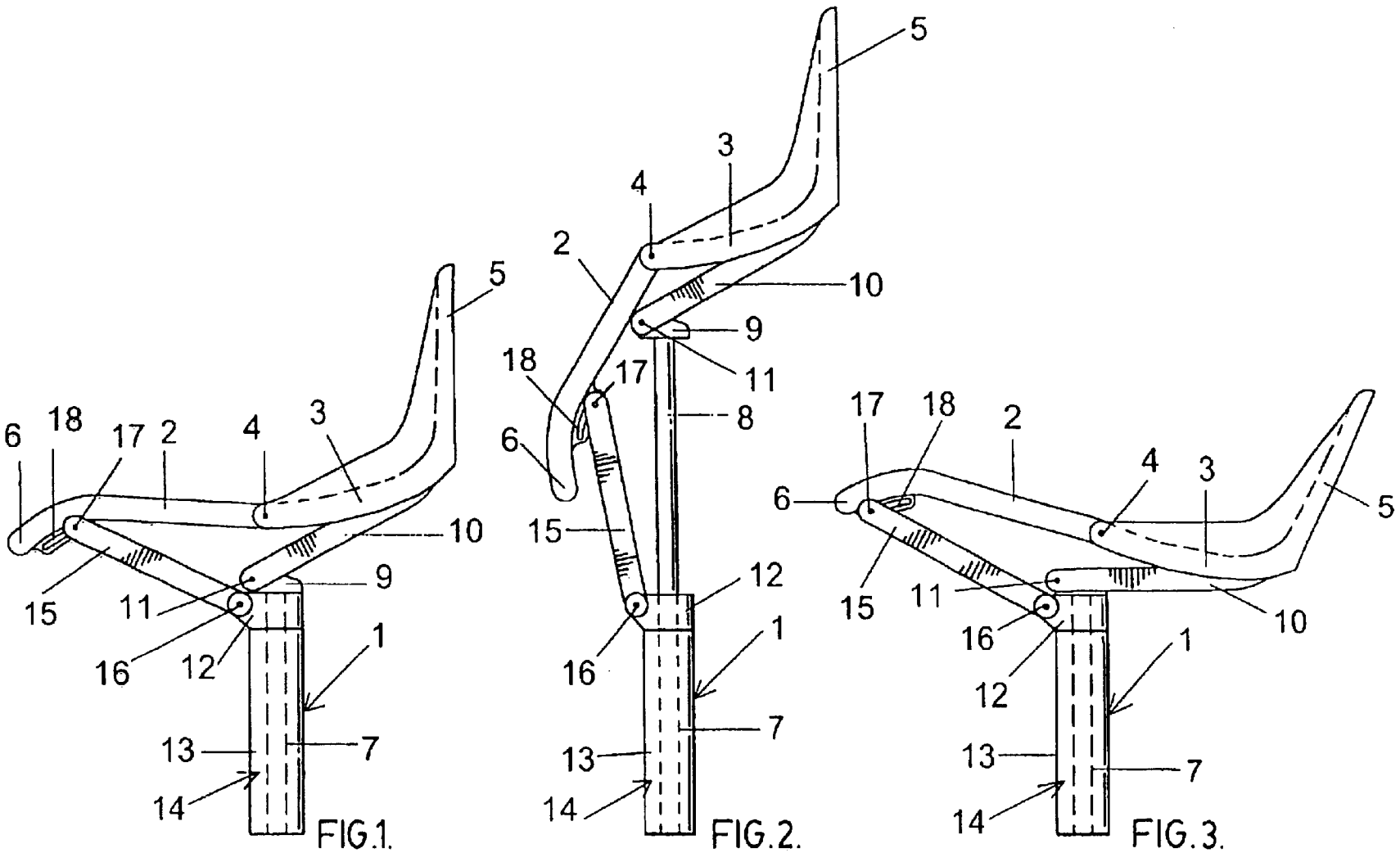
FIGS. 1 to 27 are schematic representations.

FIGS. 1 to 4 show an adjustable work chair such as an office chair, comprising a centre column 1 which forms part of a "spider" type of chair base (not shown) having casters for movement across a floor and a cushioned, height-adjustable seat made up of a front part 2 and a rear part 3 that are connected by a hinge 4 that extends transversely of the seat, towards the rear thereof. A back rest 5 extends upwardly from the rear part 3 of the seat and can be made separately or in one piece with the rear part 3. Back rest 5 may be height-adjustable with respect to seat part 3. Part 3 itself is formed with a slight curvature. The front part 2 of the seat is generally flat but may be curved at the front.

Figure 5:
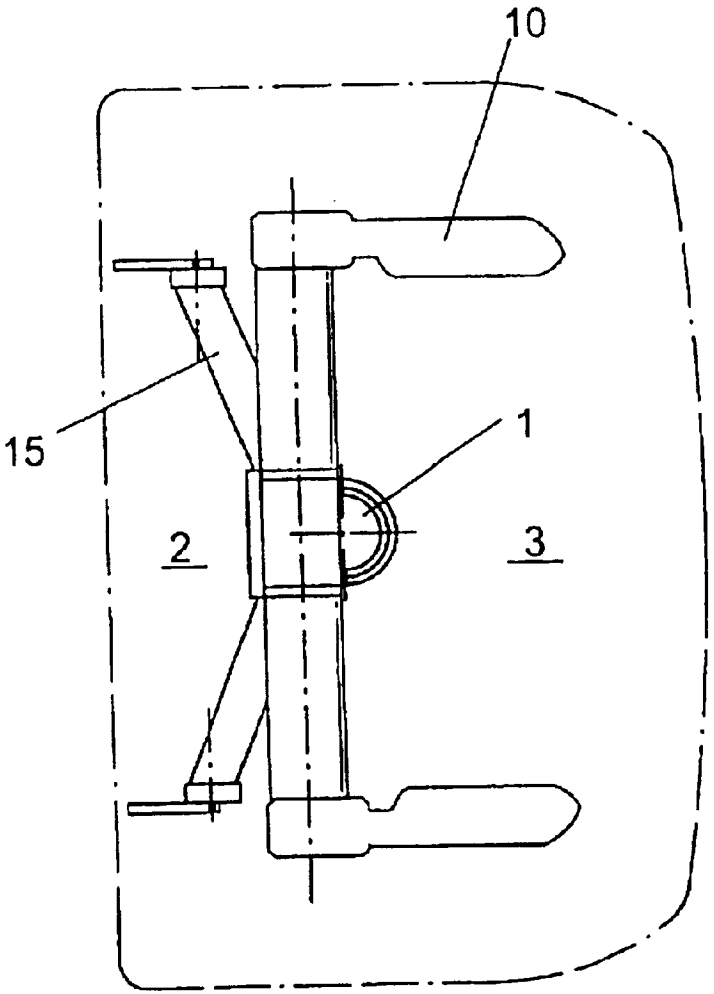
Figure 4:
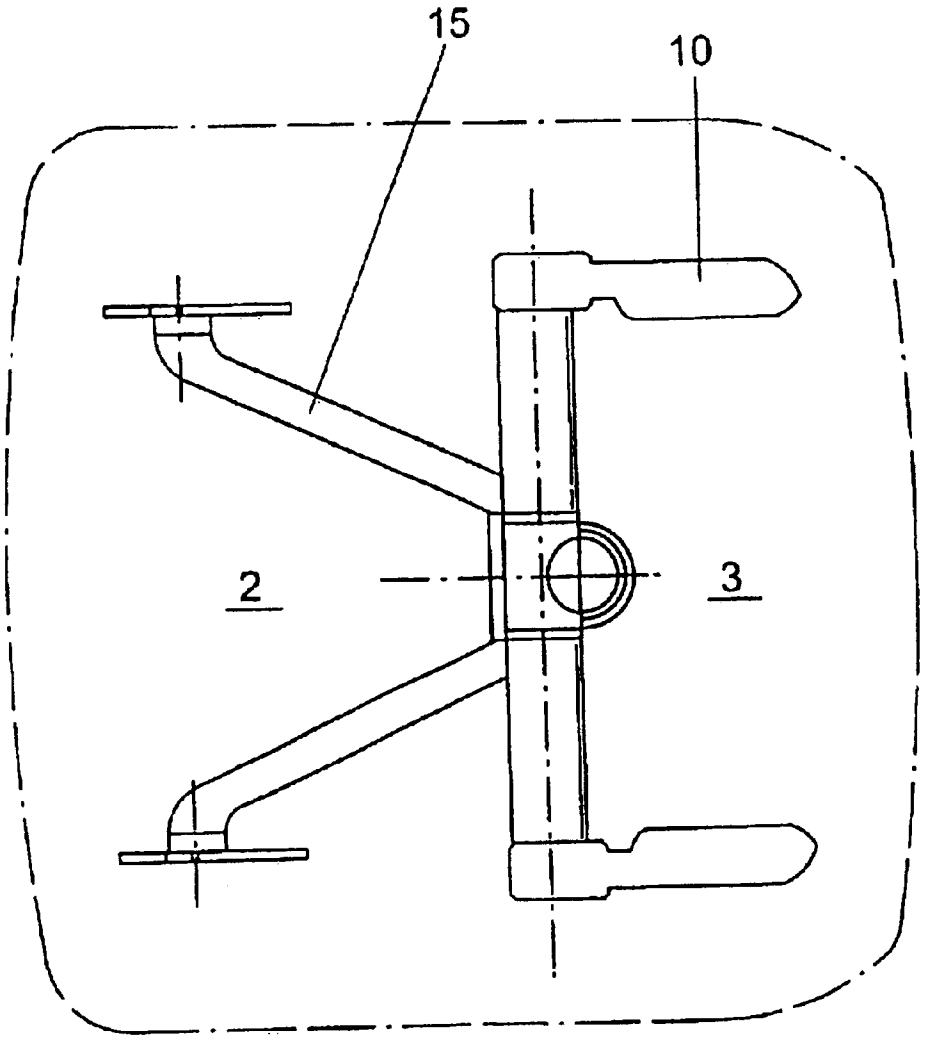
Figures 6, 7, 8:
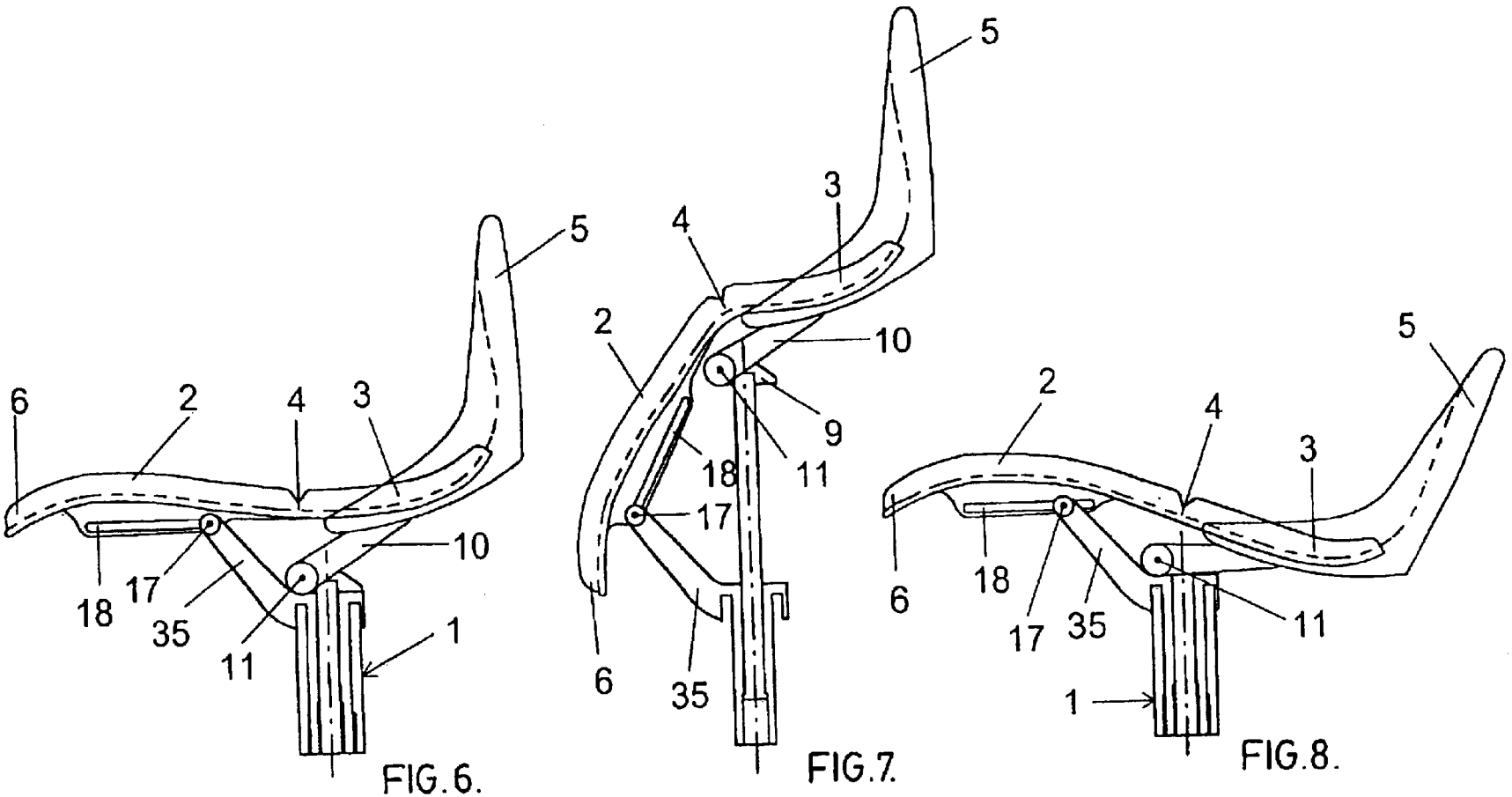
Figure 10:
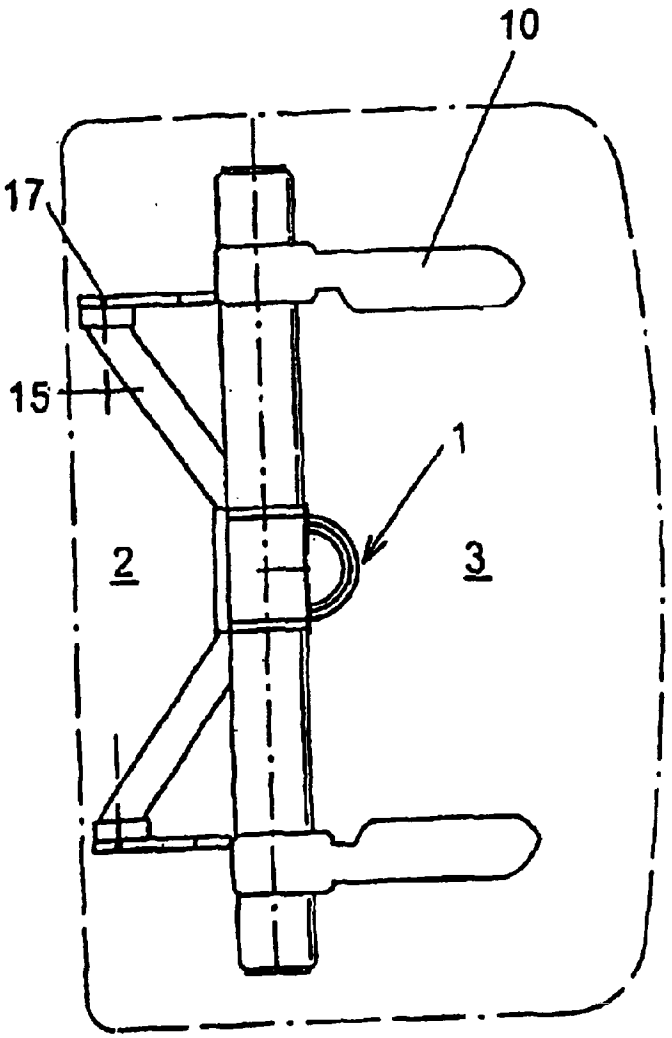
Figure 9:
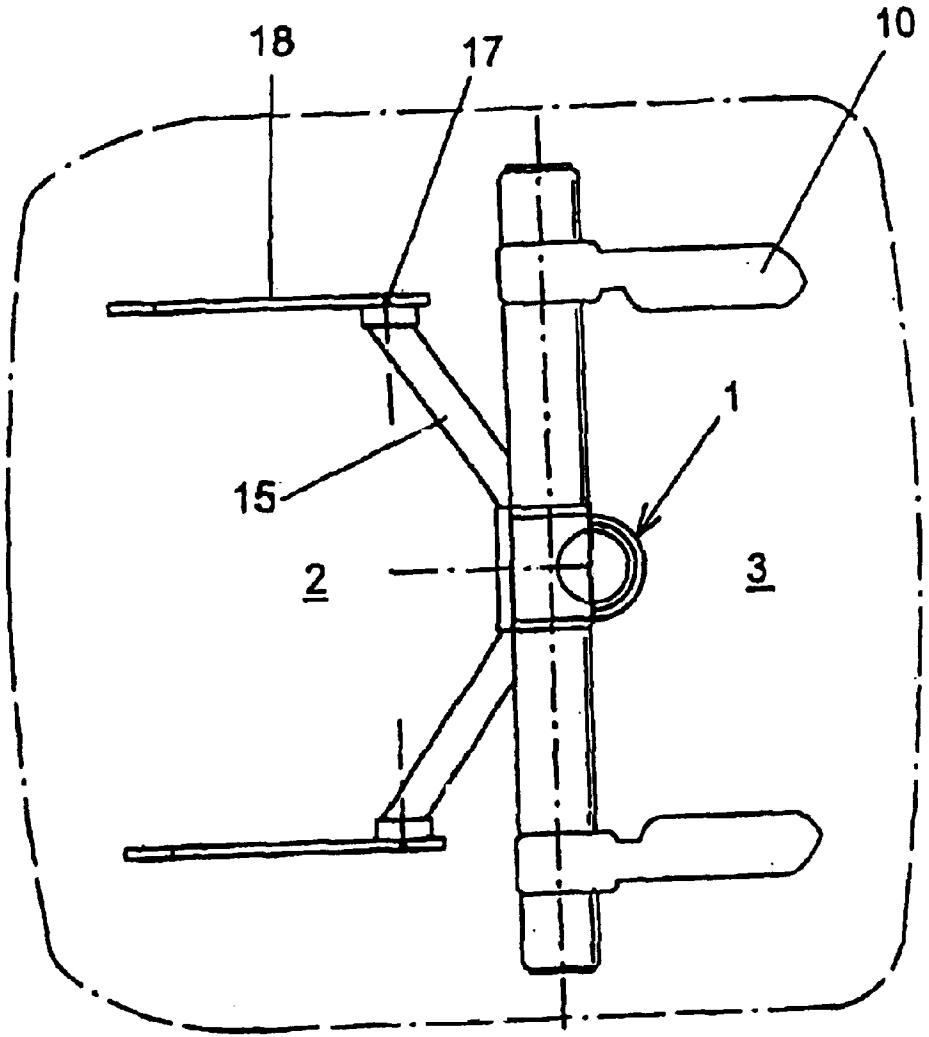
Figures 11, 12, 13, 14:
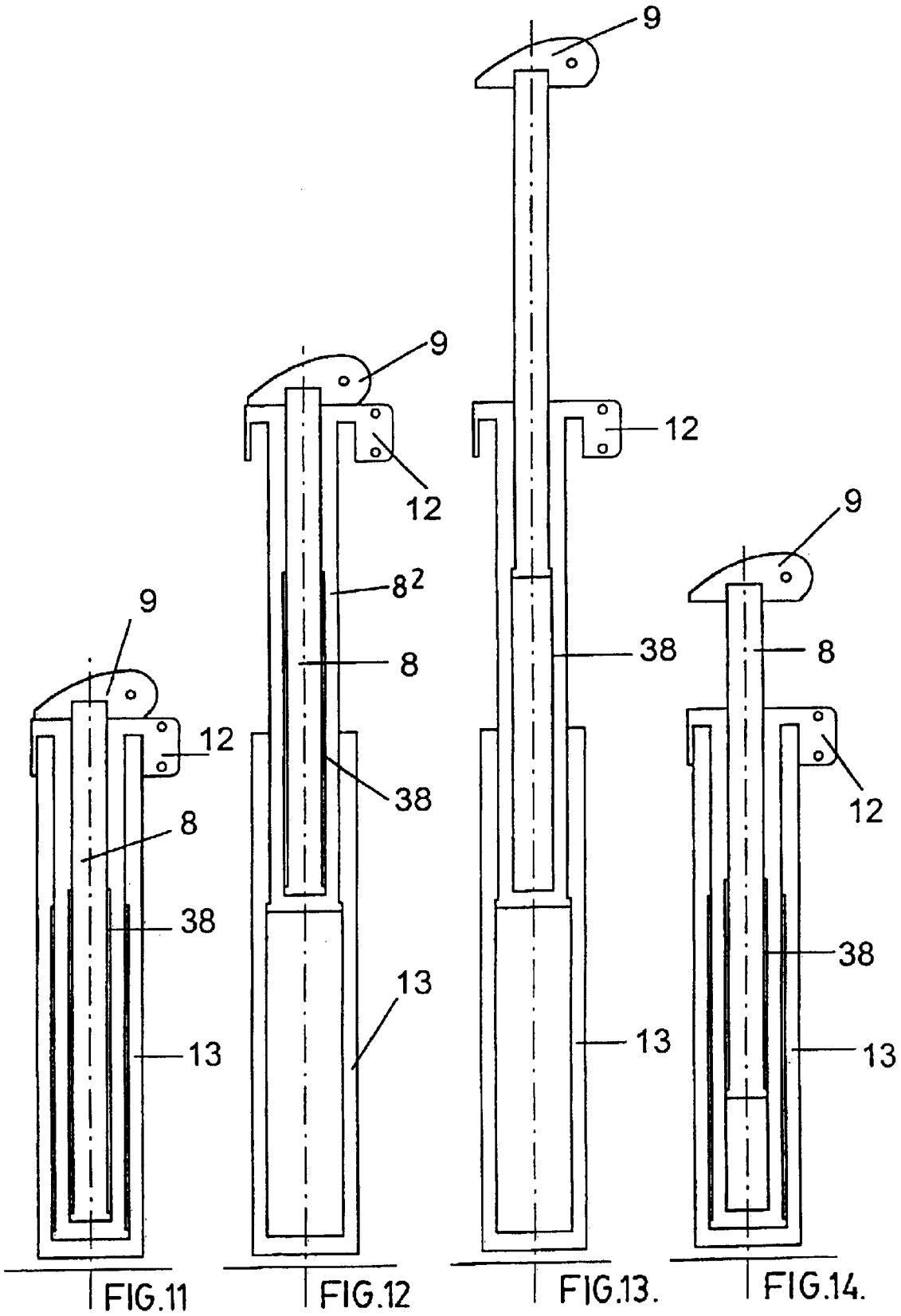
Figure 21:
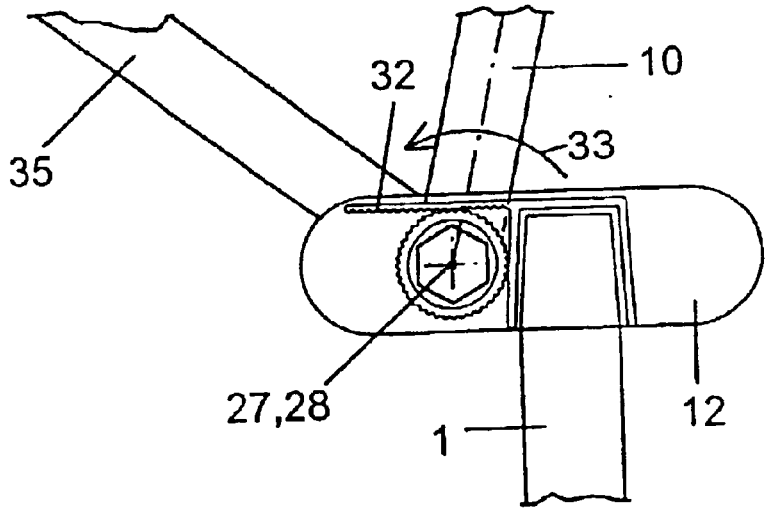
Figure 20:
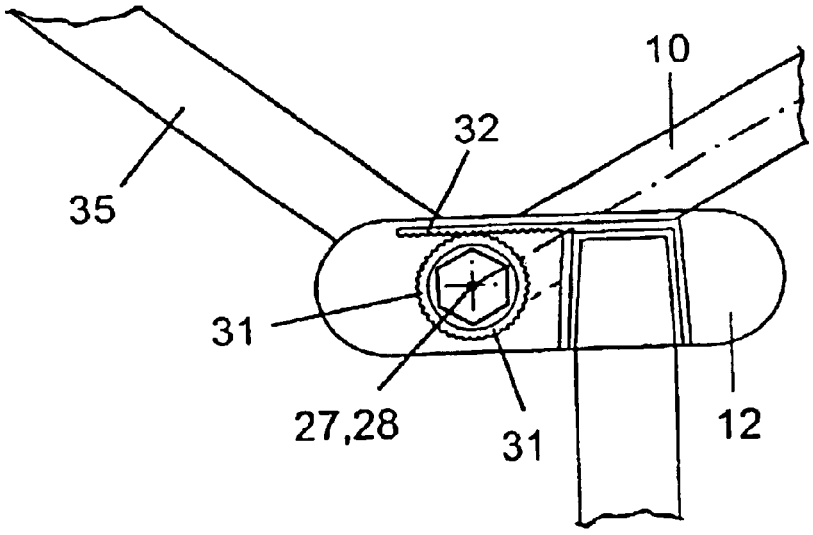
Figure 22:
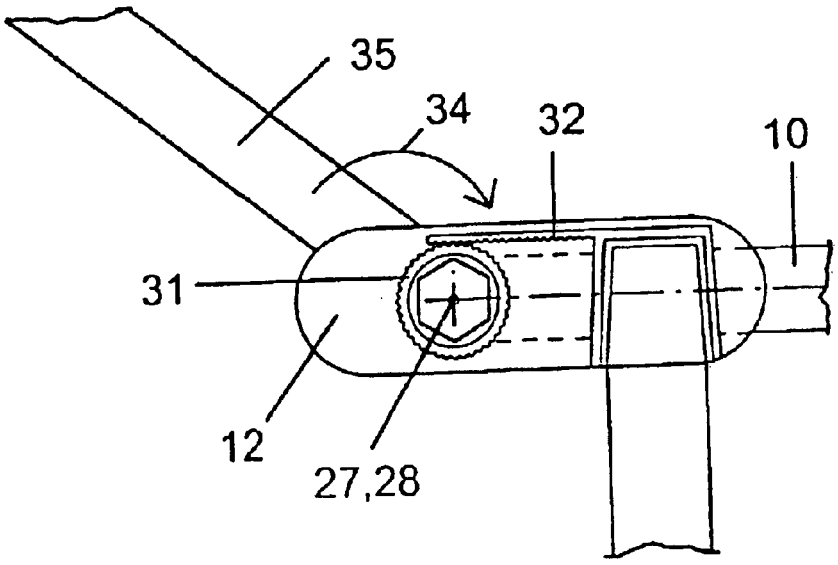
Figures 23, 24, 25:
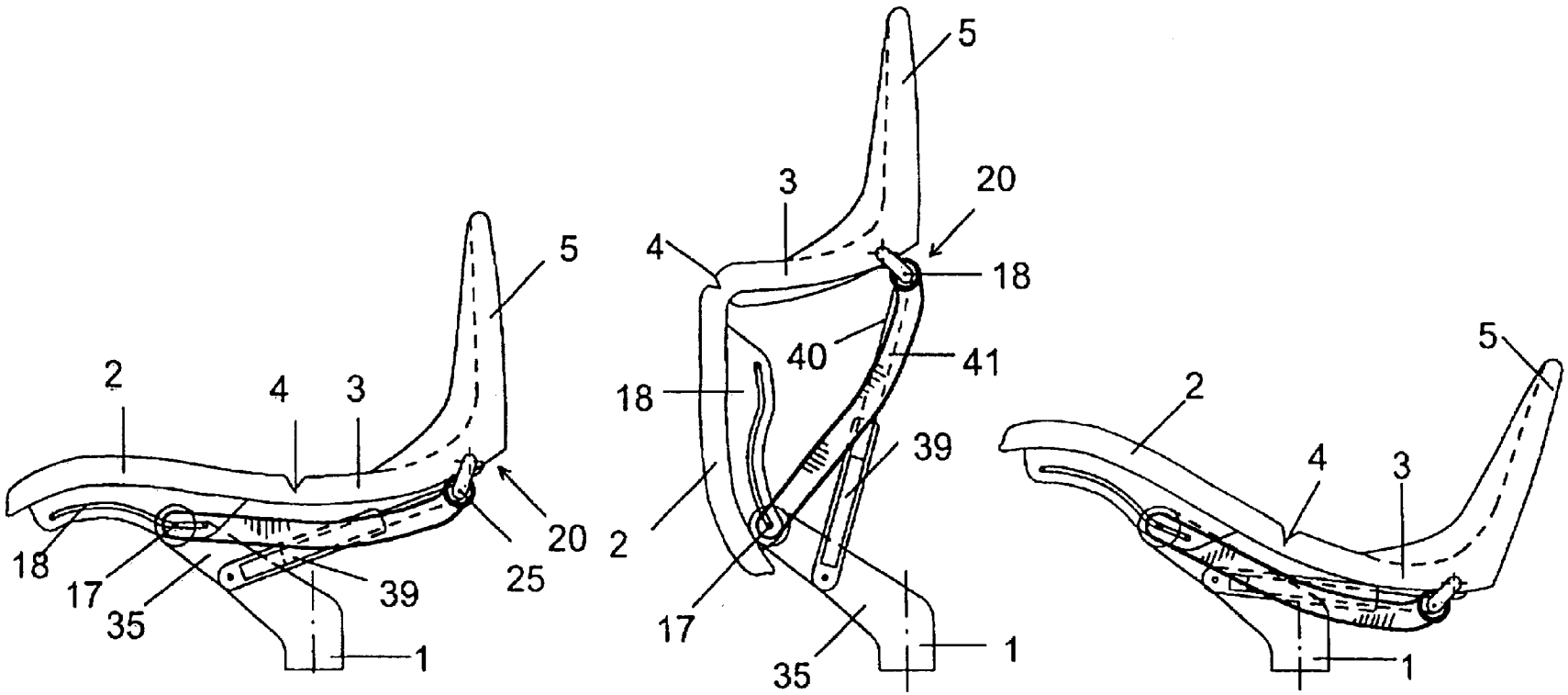
Figure 27:
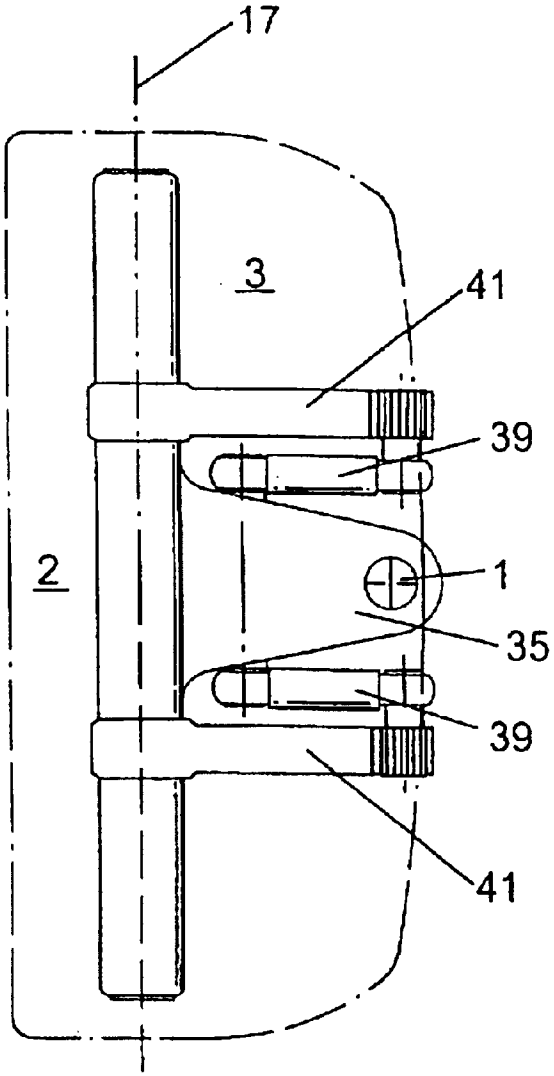
Figure 26:
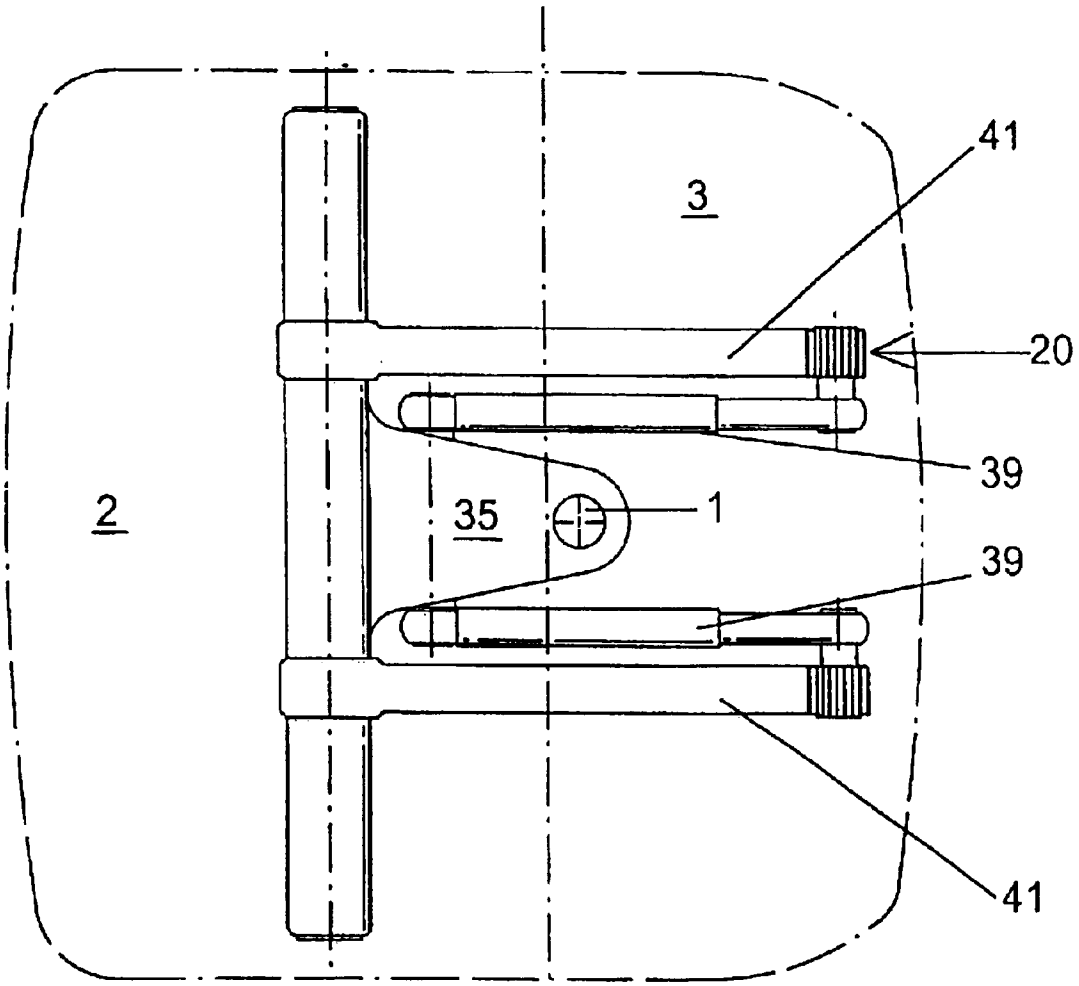
Figure 28:
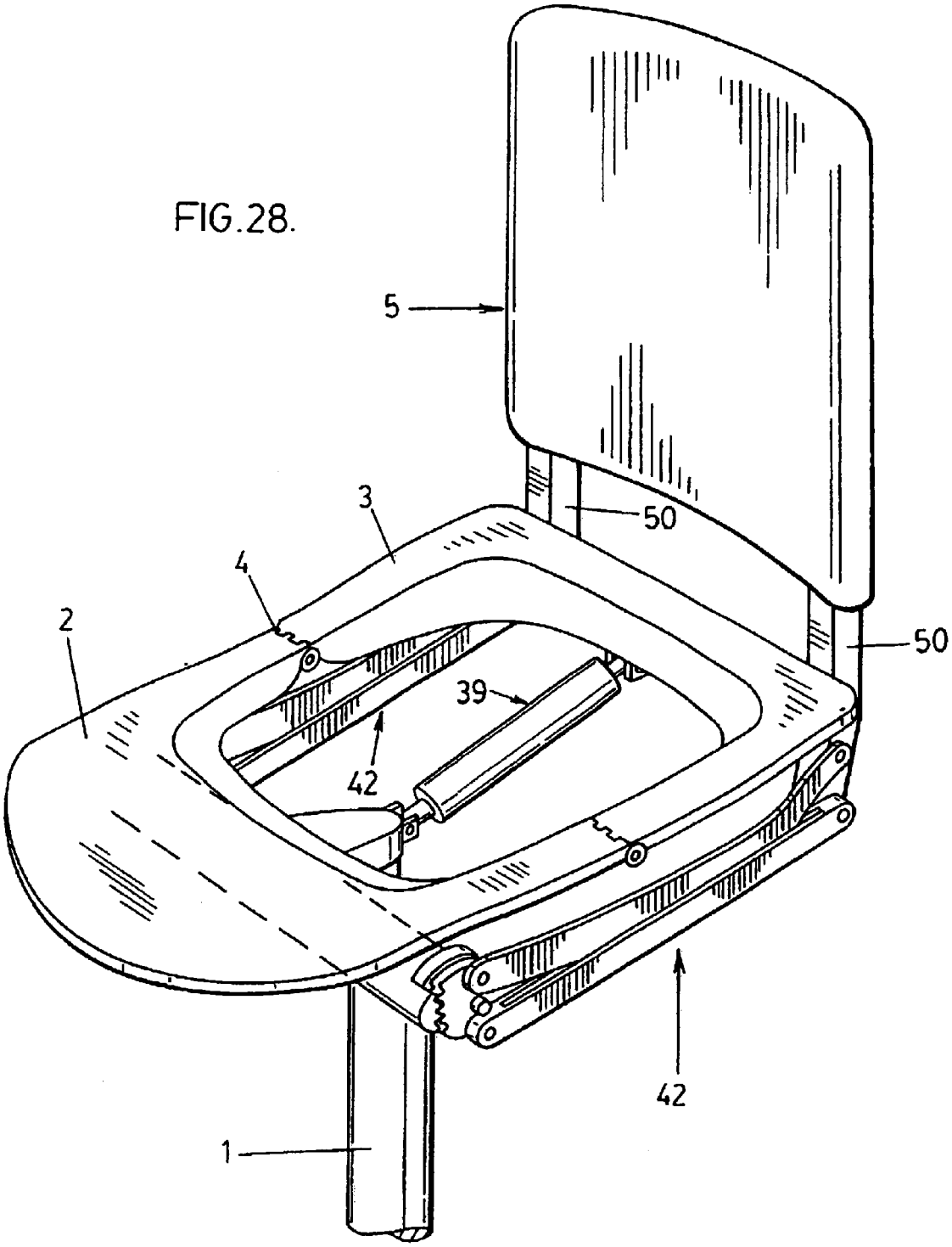
FIG. 28 is a perspective view from above of a chair in accordance with the fourth embodiment of the invention.

The centre column 1 includes a gas spring having a telescopically extendible piston rod 8 provided at its free end (head 9) with a joint 11 which connects to an arm 10 and is provided with a spring element such as a spiral or torsion bar 28 (see FIGS. 20–22), for synchronizing rearward tipping motion. At the same time, the rotational joint 11 is automatically blocked if lift exceeds 540 mm. Arm 10 as represented in FIGS. 1 to 3 is firmly attached to the underside of the rear seat part 3 and attached statically or height-adjustably to the back rest 5. Another arm 15 is attached by a rotational joint 16 to the head 12 of the housing 13 for the gas spring (which forms a lift). The free end of arm 15 is coupled to the front seat part 2 near its front end by a rotational joint 17. Arm 15 is coupled to the front seat part 2 by way of a guide mechanism 18. As can be seen from the top views of FIGS. 4 and 5, arms 10 and 15 are provided at both sides of the seat (i.e. double arms are used).

FIG. 1 shows the normal seated position of the adjustable work chair in which the front and rear parts 2, 3 form an essentially horizontal seating surface. The rear part 3 makes a slightly arched transition into the back rest 5, which may be adjustable relative to rear seat part 3.

In the embodiment of FIGS. 6 to 10, the front arm 15 is firmly attached to the fixed head 12 of the column housing 13, in contrast to the first embodiment of FIGS. 1 to 5. Guide mechanism 18 is longer than in the first embodiment.

FIGS. 11 to 14 show the gas spring 7 in the centre column 1. The gas spring 7 is a multi-stage telescopic gas spring, in which a gas spring (piston rod 8) is extendable outwardly from another gas spring (hollow piston rod $\mathbf{8}^2$), which in turn is guided inside a cylinder 13. Technically, up to three gas springs may be coupled together in this way. Settings 1 and 2 adjust the standard height over an adjustment range of 120 mm, according to established requirements. A stand/lean height of about 800 mm can be achieved with settings 2 and 3.

FIG. 2 shows the piston rod 8 of the gas spring 7 fully extended in the first embodiment. This essentially preserves the horizontal position of the rear part of the seat 3 at the transition to the back rest 5 by means of the arm 10 that is joined to the extendible head 9 of piston rod 8. However, the seat part 2 has been turned through about 60° from the horizontal at the hinge, while arm 15 has rotated to define an acute angle with piston rod 8. In the stand/lean position, the front part 2 of the seat is used for leaning. The legs of the user are slightly angled while his or her posterior rests in the trough-like shell at the transition of the rear seat part 3 to the back rest 5. Therefore, a stand/lean/sit position is available to the user to relieve his or her feet.

In the rest position shown in FIG. 3, arm 10, which fixed firmly to the rear seat part 3, has been turned towards the horizontal. The front part 2 of the seat tilts through a small angle from the horizontal towards seat part 3, which is connected with back rest 5, which now slants rearwardly (synchronized movement). The rotational joint 17 at the free end of arm 15 has moved closer to the front 6 of the seat part 2, within guide mechanism 18. In this position, the user of the adjustable work chair can rest.

In the third embodiment of the adjustable chair, represented in FIGS. 15 to 18, the centre column 1, the front part 2 of the seat, the rear part 3 of the seat, back rest 5 and hinge 4, as well as the front part 6 of the seat including the guide mechanism 18 are present in the same manner as in the first and second embodiments according to FIGS. 1 to 10. The two arms 10 and 15, of which arm 15 connects with the guide mechanism 18 through a rotational joint 17 also are present. However, there are four important differences from the two earlier embodiments.

The first difference is that arm 10 is not directly attached to the rear part 3 of the seat but is linked to that part by a joint 20 which contains toothed segments so that it can be moved synchronisely. A fixed shaft 22 on the underside of the rear seat part 3 has a toothed segment 23 that engages a toothed wheel 24 that is mounted on a fixed shaft 25 at the outer end of arm 10. Bearing shells 26 extend around the fixed shaft 22 in such a manner that the toothed segment 23 continuously engages the toothed wheel 24. Joint 20 ensures that back rest 5 remains essentially in a vertical position as it rises from the seated position of FIG. 15 to the lean/stand position of FIG. 16.

The second difference is that the arm 10 is mounted on a shaft 27 that is attached to the centre column 1 of the work chair at the height of head 12. A spring element, e.g. a torsion bar and/or a spring bar 28 (FIGS. 20–22) mounted in shaft 27 makes it possible to adjust the front seat part 2 from the seated position of FIG. 15 to the stand/lean position of FIG. 16 by the torque effect of the spring element and possibly additional torque by a parallelogram motion, and to fold down the front part 2 of the seat so that between one half and two thirds of the area of the seat is folded down while the back part 3 of the seat with the back rest 5 remains in position. In this case, the entire adjustment range from the upright stand/lean position through the upright seated position to the reclining rest position of FIG. 17 is controlled by synchronized movement of the torsion bar and/or spring bar 28 in joint 20 within shaft 27.

The third difference is that the front arm 35 is firmly fixed to the head 12 of centre column 1.

Figures 15, 16, 17:
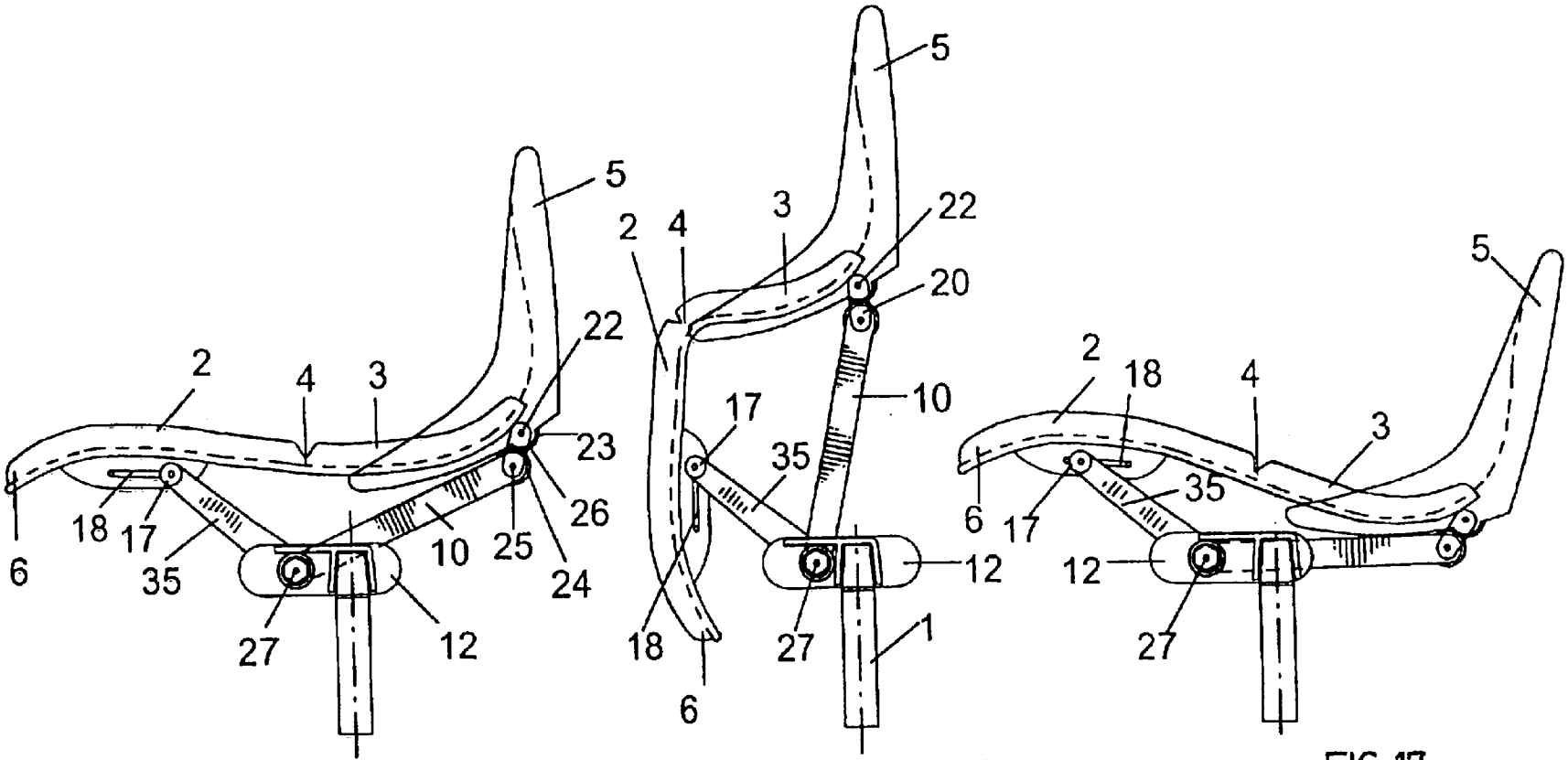
Figure 19:
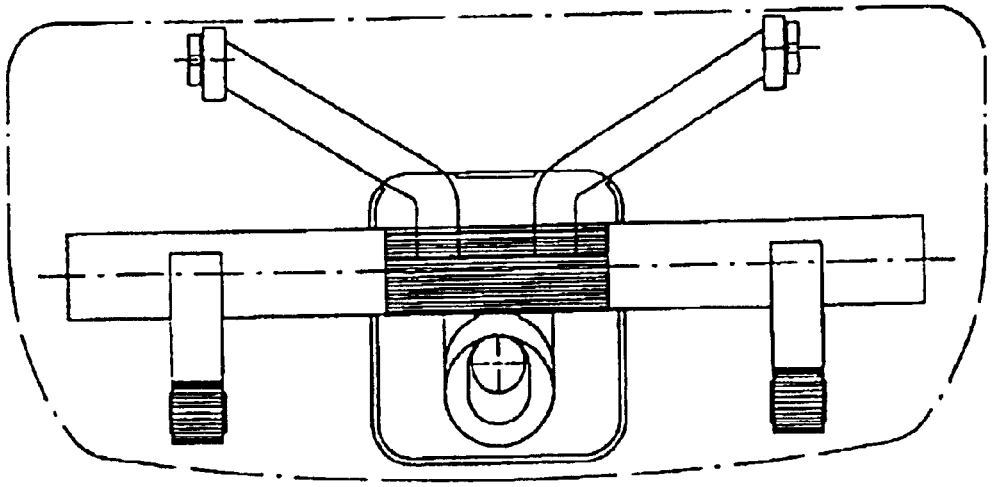
Figure 18:
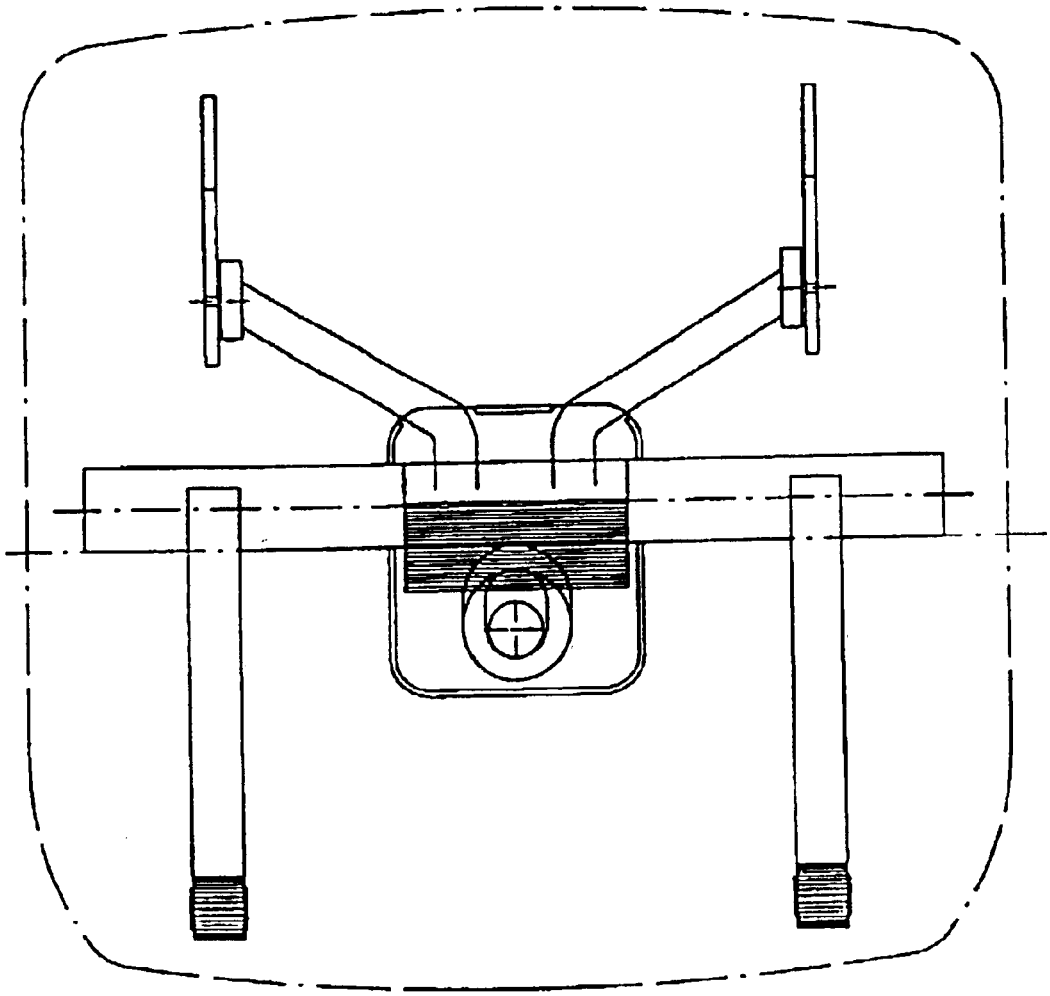

The fourth difference is that a mechanical device is provided for balancing extreme weight shift, e.g. as in the lean/stand position of FIG. 16 and the reclining rest position of FIG. 17. This device (30) is shown in three different positions in FIGS. 20 to 22 and is explained in more detail below.

Shaft 27 carrying the two arms 10, 35 is provided with a torsion bar and/or spring bar 28, which is surrounded by a toothed wheel 31 that engages a horizontal toothed rack 32 fixed on the head 12 of the centre column. Arm 10, which is connected to the rear part 3 of the seat through joint 20, acts upon the toothed wheel 31 through shaft 27 in such manner that the shaft is turned forwardly in the direction of arrow 33 in FIG. 21 towards the head 12 of the centre column 1 when raising arm 10. The load on the work chair in the stand/lean position according to FIG. 17 is brought closer to the centre column 1, so that the tilt moment is considerably reduced. During weight shift backwards into the rest position of FIGS. 17 and 22, arm 10 turns clockwise according to arrow 34 and the toothed wheel 31 is turned rearwardly on rack 32, as a result of which the centre of gravity of the work chair in the rest position of FIG. 17 is located over the centre column 1 of the work chair. Weight balance device 30 permits an extreme frontal lean/stand position and an extreme rearward rest position while ensuring stability of the work chair. The entire adjustment range, depending on the size of the toothed wheel 27 and the rack 32, typically lies between 2 to 5 cm. The drawings do not show the motion of shaft 27 in device 30 during horizontal rolling motion of the toothed wheel 32, or exact alignment and positioning of the torsion bar 28 in shaft 27.

In a fourth embodiment illustrated in FIGS. 23 to 27, a spring element 39 (either a gas spring or a compression spring) is coupled at one end to a fixed arm 35 that extends forwardly from centre column 1 at an angle of about 60°, and includes a piston rod 40 that is coupled to a shaft 25 of joint 20 on the underside on the rear seat part 3. Arm 41 connects the shaft 25 of joint 20 with the rotational axis 17 of the guide mechanism 18. By extending the piston rod 40, the front seat part 2 is folded almost vertically downwardly as shown in the stand/lean position of FIG. 24. As in all of the other embodiments, the rear seat part 3 is lifted together with the back rest 5 by means of arm 41, whereupon the rotational joint 17 of the guide mechanism 18 is moved from the rearward position of FIG. 23 to the forward position of FIG. 24. The stand/lean position is attained while simultaneously turning the front seat part 2 into a vertical position.

Instead of the rotational shaft 17, a torsion bar and/or a spring bar can be installed to cause rotational movement into the chair/lean position. The spring element 39 may then be replaced by a simple guide.

Reference will finally be made to FIGS. 28 to 32 which show a chair in accordance with the fourth embodiment of the invention (FIGS. 23 to 27) but in which the arm 41 is replaced by a link mechanism that is generally indicated at 42. Otherwise, the same reference numerals are used to denote parts that are the same as in FIGS. 23 to 27.

Figure 29:
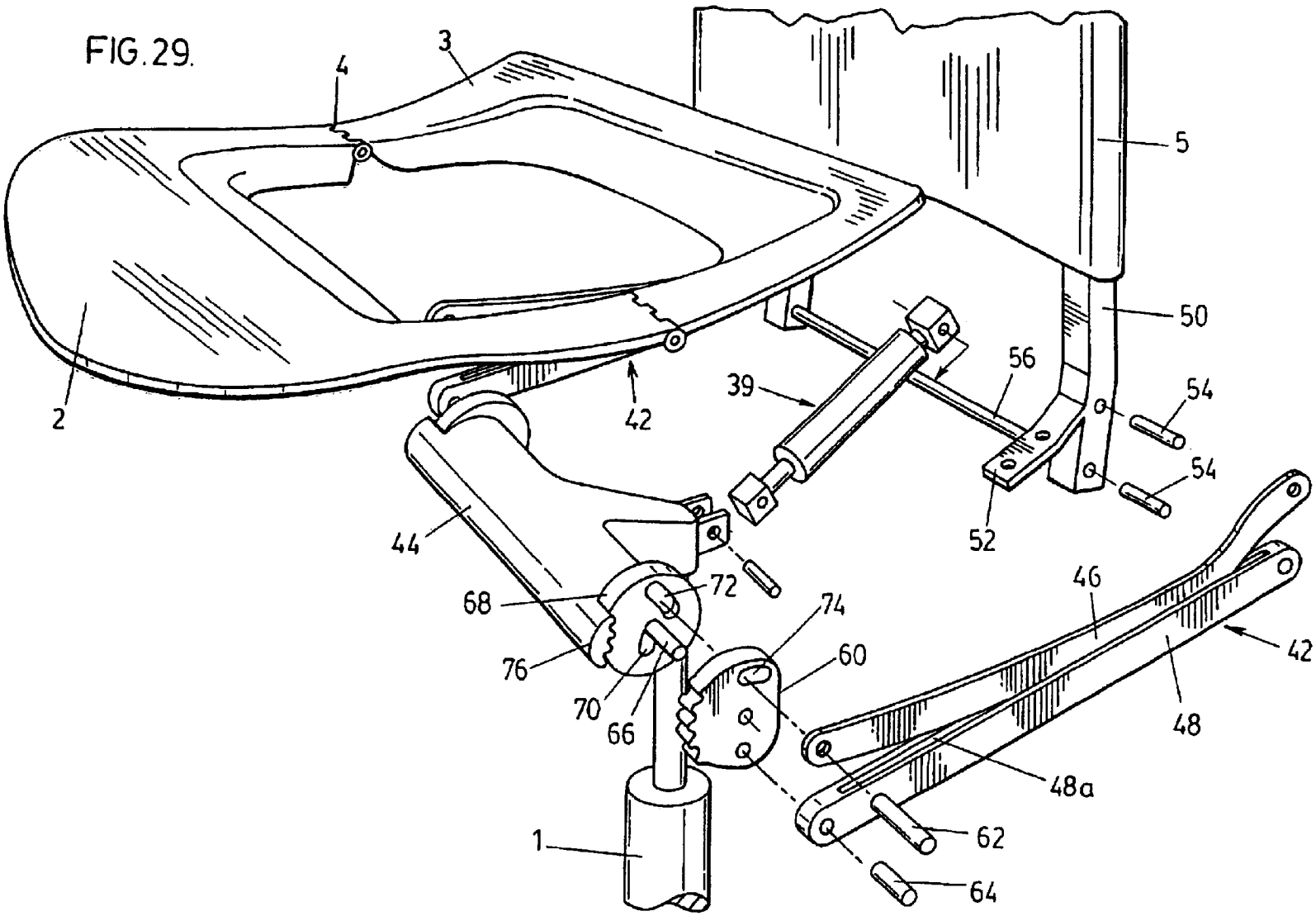
FIG. 29 is an exploded perspective view similar to FIG. 28.
Figure 30:
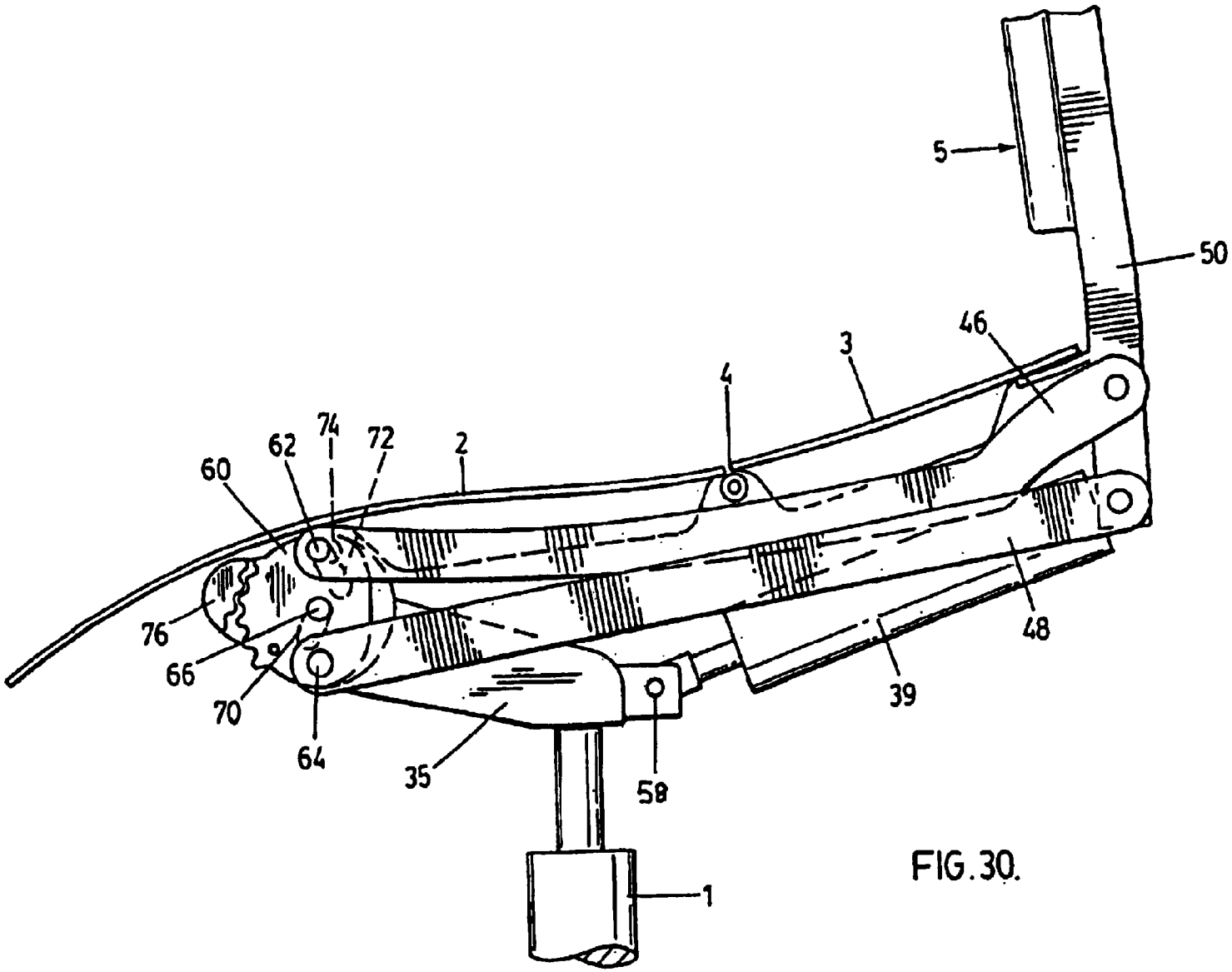
FIGS. 30, 31 and 32 are side elevational views showing the chair of FIGS. 28 and 29 respectively in the normal seating position, sit/stand position and recline/seating position.
Figure 31:
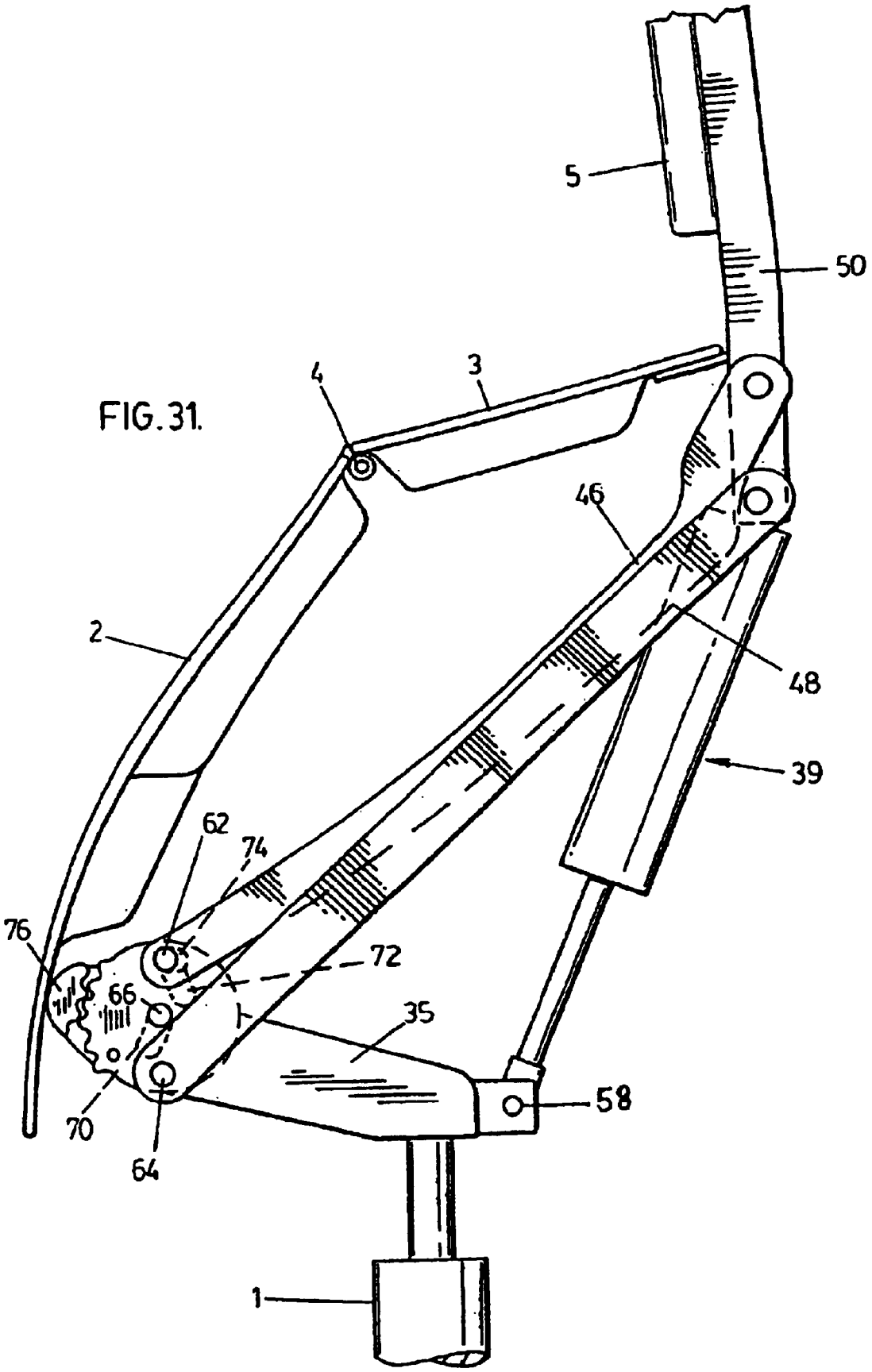

As best seen in FIGS. 30 and 31, arm 35 extends forwardly and upwardly from the top of column 1 generally as in the previous embodiment. A head 44 (FIG. 29) extends transversely of the outer end of arm 35 and mechanism 42 is mounted at one end of the head. A second identical mechanism 42 is mounted at the other end of the head as best seen in FIG. 29. The mechanism includes a pair of links 46 and 48 that extend upwardly from head 44 to the rear seat part 3.

In fact, the two links are coupled to the rear seat part 3 by way of the back 5 of the chair in that upper ends of the respective links 46 and 48 are pivoted to one of the upright side members 50 of the back. The rear seat part 3 is attached to a pair of brackets on the side members of the seat, one of which is visible at 52 in FIG. 29. That view also shows pivot pins 54 for coupling the links 46, 48 to the side member 50.

Also shown is a transverse bar 56 that extends between the two side members 50 of the back and serves as a mounting point for one end of the gas spring 39 of the chair. Gas spring 39 is shown mounted in a reversed position as compared with FIGS. 23 to 27 but operates in the same fashion. The spring includes a piston rod 40 that extends downwardly to and is pivotally coupled to the column 1 by pivot pin 58.

Front seat part 2 may be coupled to head 44 by a mechanism similar to guide mechanism 18 referred to previously.

With continued reference to FIG. 29, it will be seen that the two links 46 and 48 are pivotally coupled at their ends adjacent column 1 to a gear sector element 60 by way of respective pivot pins 62 and 64. Element 60 is in turn mounted on a pivot pin 66 that extends horizontally outwardly from head 44 parallel to the two pivot pins 62, 64 for the links 46, 48. Pin 66 is in fact carried by a disc-shaped element 68 at the relevant end of head 44 and is capable of a limited degree of arcuate movement in a slot 70 in element 68. A similar but differently oriented slot 72 is provided in element 68 to receive an inner end portion of the pin 62 for link 46. Pin 62 extends right through gear sector element 60 by way of a further arcuate slot 74 in element 60. Pin 64 is shorter than pin 62 and does not extend through element 60.

Figure 32:
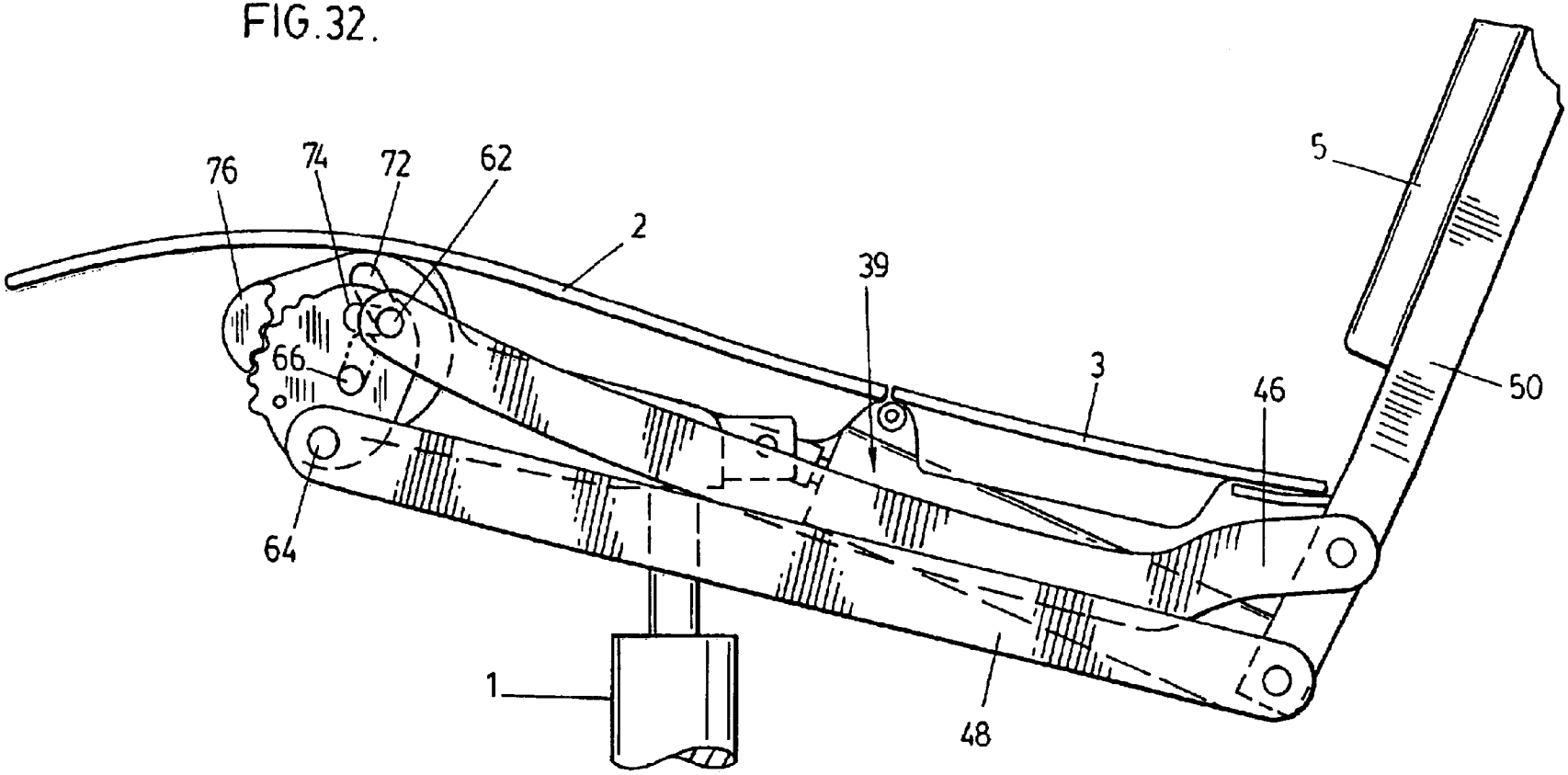

Finally, a fixed, toothed sector 76 extends outwardly of disk element 68 for engagement with the teeth of gear sector element 60, as best seen in FIGS. 30 to 32. Sector 76 and element 60 are known as "section gears".

The elements of mechanism 42 that are carried by head 44, and in particular the arrangement of pivot pins and arcuate slots is designed to cause the sequence of movement of the various components of the chair that is apparent from a comparison of FIGS. 30 to 31. It will be seen that link 48 is slotted at 48*a* to receive link 46, while permitting independent relative movement of the links with respect to one another.

As the piston rod 40 of gas spring 39 is extended from the normal seating position of FIG. 30, the links 46, 48 act as a normal parallelogram linkage and the rear seat part 3 and back rest 5 rise parallel to their initial positions. Pivot pins 62 and 66 do not move in their respective slots 74, 72 and 70. The front seat part 2 folds with respect to the rear seat part 3. Conversely, if piston rod 40 of gas spring 39 is retracted from the position shown in FIG. 30, the bottom link 48 is placed in compression and element 60 turns in the clockwise direction around the fixed teeth 76, causing pivot pins 62 and 66 to move down in their respective slots 72 and 70 and causing pin 62 to move rearwardly in slot 74, so that the back rest 5 tilts rearwardly to the position shown in FIG. 32.

It is of course to be understood that the preceding description relates to particular preferred embodiments of the invention only and that many modifications are possible within the broad scope of the invention. Some of those modifications have been mentioned and others will be apparent to a person skilled in the art.

I claim:

1. A chair having a height-adjustable seat comprising a front seat part (2) and a rear seat part (3) connected by a hinge (4) that extends transversely of the seat, the chair further comprising: a lift (14) for raising and lowering the seat, the lift including a fixed part (13) and a movable part (8) that can be extended upwardly with respect to the fixed part (13); a first arm (15) connected between the front part (2) of the seat and the fixed part (13) of the lift, and a second arm (16) connected between the movable part (8) of the lift and the rear part (3) of the seat.

2. A chair as claimed in claim 1, wherein the first arm (15) is coupled to the fixed part (13) of the lift at a rotational joint (16).

3. A chair according to claim 1, wherein the fixed part (13) of the lift comprises a centre column (1) supporting the seat, and wherein the first arm (15) is firmly connected to an upper end portion (12) of the centre column (1).

4. A chair according to any one of claims 1 to 3, wherein the first arm (15) is coupled to the front part (2) of the seat by a guide mechanism (18).

5. A chair according to any one of claims 1 to 3, wherein the lift comprises a gas spring (7) having an extendable piston (8) including a head (9) which is coupled by a joint to said second arm (10) that extends to the rear part (3) of the seat.

6. A chair having a height-adjustable seat comprising a front seat part (2) and a rear seat part (3) connected by a hinge (4) that extends transversely of the seat, the chair further comprising: a first arm (15) connected at a joint to the front part (2) of the seat, and a second arm (10) connected to the rear part (3) of the seat at a joint (20) containing toothed segments, the two arms (10, 15) being coupled on a common shaft (27) to a centre support column (1) of the chair and including a spring element (28) permitting adjustment of the arms (10, 15) with respect to each other.

7. A chair according to claim 6, wherein the common shaft (27) including the spring element (28) is coupled to the centre column (1) by way of a pinion (31) that engages a toothed rack (32) on the top (12) of the centre column (1).

8. A chair having a height-adjustable seat comprising a front seat part (2) and a rear seat part (3) connected by a hinge (4) that extends transversely of the seat, the chair further comprising a first arm (35) coupled to the front part (2) of the seat at a joint, and a second arm (41) coupled to the rear part (3) of the seat, the first arm (35) being coupled to a centre column (1) of a seat support and being directed forward at an angle of approximately 60°; a spring element (39) being coupled to the first arm (35) intermediate the ends of the arm and having a piston rod (40) coupled to the underside of the rear part (3) of the seat at an axis (25) of a joint coupling; said second arm (41) being coupled to the front part (2) of the seat at a joint (17) on axis (25) by way of a guide mechanism.

9. A chair having a height-adjustable seat comprising a front seat part (2) and a rear seat part (3) connected by a hinge (4) that extends transversely of the seat, the chair further comprising a first arm means (35) pivotally coupled to the front part (2) of the seat, and a second arm means (35) being coupled to a centre column (1) of a seat support and being directed forwardly towards the front part (2) of the seat; and actuator means coupled between the first arm means (35) and the rear part (2) of the seat for raising and lowering the rear part of the seat between a normal seating position, an elevated sit/stand position, and a reclined position, wherein the second arm means comprises a parallelogram mechanism connected between the rear part of the seat and the first arm means and including a pair of links that cause the rear part of the seat to move between the seated position and the elevated sit/stand position while remaining parallel, the mechanism including section gear means at the ends of the links, adapted to modify motion of the rear part of the seat in moving to said reclined position so that said rear seat part angles downwardly with respect to its orientation in said seated position.

* * * * *